US006321702B1

(12) United States Patent
Diehl et al.

(10) Patent No.: US 6,321,702 B1
(45) Date of Patent: Nov. 27, 2001

(54) PROCESS FOR CONTROLLING A GAS EXCHANGE VALVE FOR INTERNAL COMBUSTION ENGINES

(75) Inventors: Udo Diehl, Stuttgart; Karsten Mischker, Leonberg; Rainer Walter, Pleidelsheim; Stefan Franzl, Grosshelfendorf; Volker Beuche, Stuttgart; Stefan Reimer, Markgroeningen, all of (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/485,541

(22) PCT Filed: Feb. 16, 1999

(86) PCT No.: PCT/DE99/00424

§ 371 Date: May 11, 2000

§ 102(e) Date: May 11, 2000

(87) PCT Pub. No.: WO99/66178

PCT Pub. Date: Dec. 23, 1999

(30) Foreign Application Priority Data

Jun. 12, 1998 (DE) ..... 198 26 045

(51) Int. Cl.[7] ..... F01L 9/02
(52) U.S. Cl. ..... 123/90.12; 123/198 C
(58) Field of Search ..... 123/90.12, 90.13, 123/90.15, 198 C

(56) References Cited

U.S. PATENT DOCUMENTS

| | | | | |
|---|---|---|---|---|
| 4,009,695 | * | 3/1977 | Ule | 123/90.13 |
| 4,930,464 | * | 6/1990 | Letsche | 123/90.12 |
| 4,930,465 | * | 6/1990 | Wakeman et al. | 123/90.12 |
| 5,572,961 | * | 11/1996 | Schechter et al. | 123/90.12 |

FOREIGN PATENT DOCUMENTS 05-202712 * 8/1993 (JP) .

* cited by examiner

*Primary Examiner*—Weilun Lo
(74) *Attorney, Agent, or Firm*—Ronald E. Greigg

(57) ABSTRACT

A system for controlling a gas exchange valve for internal combustion engines, comprising a movable valve member in a housing which, on an end close to the combustion chamber, has a valve sealing face that cooperate with a valve seat in order to control an inlet or outlet cross section at the combustion chamber of the engine. On an end remote from the combustion chamber a working piston defines at least one hydraulic working chamber, whose alternating filling and discharging with a pressure fluid can be used to move the valve member in the opening and closing direction. The supply pressure of the pressure fluid supplied for the actuation of the gas exchange valve member is adjusted step wise as a function of current operating parameters of the engine.

14 Claims, 1 Drawing Sheet

PROCESS FOR CONTROLLING A GAS EXCHANGE VALVE FOR INTERNAL COMBUSTION ENGINES

PRIOR ART

The invention is based on a process for controlling a gas exchange valve for internal combustion engines. In a device of this kind, which has been disclosed by DE 195 11 320 and is for controlling a gas exchange valve, the gas exchange valve has an axially movable valve member which, on its end close to the combustion chamber, has a valve sealing face that it uses to cooperate with a stationary valve seat in order to control an inlet or outlet cross section at the combustion chamber of the engine. On its end remote from the combustion chamber, the valve member of the gas exchange valve has a working piston which, with its axial end faces, defines two hydraulic working chambers, of which an upper working chamber further from the combustion chamber can be alternatingly filled with a pressure fluid and discharged, and which consequently acts on the valve member of the gas exchange valve in the opening or closing direction counter to a constant closing force acting on the underside of the piston. The constant closing force on the valve member piston is assured through the fact that the lower working chamber close to the combustion chamber constantly communicates with a high pressure fluid source.

The known control device, however, has the disadvantage that it is operated with a constant pressure fluid supply pressure. This supply pressure must thereby be chosen to be at least high enough to achieve the necessary valve adjusting dynamics at the maximum speed and load of the engine as well as at low temperatures and consequently a low viscosity of the hydraulic fluid. These operating states in the engine to be fed, however, only occur temporarily in actual vehicle operation so that most of the time, an unnecessarily high pressure fluid supply pressure has to be maintained. However, since this pressure contributes directly to the power consumption of the overall vehicle system, it also impairs the overall efficiency of the engine to be fed.

Advantages of the Invention

The process according to the invention for controlling a gas exchange valve for internal combustion engines has the advantage over the prior art that the supply pressure of the valve control device is only brought to the maximum level required for the extreme boundary conditions when such a high supply pressure is actually required by the current operating parameters of the engine to be fed. The pressure fluid supply pressure produced to actuate the gas exchange valve member advantageously changes and adjusts as a function of the current operating parameters of the engine to be fed during its operation. In this manner, over broad operating cycles of the engine to be fed, it is possible to operate the valve control device with a reduced pressure that is sufficient for the normal everyday operation of vehicle engines. In this everyday operation, vehicle engines are for the most part operated at an operating temperature and in an average speed and load range in which the demands on the dynamics of the hydraulic valve control system are significantly lower than in high-stress operating states, e.g. at high speed, high load, and low temperatures. In this connection, however, the continuous variable adjustment of the supply pressure of the valve control system also assures the reliable operation of the valve control device even in the high-stress operating states of the engine that require a high pressure fluid supply pressure.

Since the supply pressure to be supplied by the high pressure pump for the valve control system contributes directly to the power consumption of the engine, a pressure reduction that is dependent on the current operating state of the engine leads directly to an energy savings in comparison to the known valve control system that has a constant supply pressure.

In this connection, the variable changing of the supply pressure level is alternatively possible by means of two strategies, wherein with a first strategy, the valve control system pressure is changed smoothly as a function of the operating parameters of the engine, e.g. the temperature, speed, and load. In this connection, it is particularly advantageous to execute the adjustment of the supply pressure level by way of a characteristic diagram stored in an electric control unit.

A second alternative strategy for the variable control of the supply pressure level is the smooth switching between different pressure levels as a function of the temperature, speed, and load of the engine to be fed. The number of pressure stages in this connection is initially variable, but an optimal design must be adapted to the respective engine. It is particularly advantageous to provide two pressure level stages, the first of which covers the lower to middle operating state of the engine and the second covers the high pressure level for the high-stress operating states. In order to prevent an excessively frequent switching back and forth between adjacent pressure levels, a hysteresis function is provided in their boundary regions.

A high pressure pump that can be regulated is advantageously used as a pressure supply device and this pump can be driven directly by the engine and at a speed synchronous to the engine so that the delivery volume of the pump already increases automatically with the speed of the engine. Alternatively, however, it is also possible to execute the regulation of the high pressure pump on the suction side, for example, by means of an adjustable suction throttle, or on the pressure side by means of corresponding pressure valves.

The valve control device advantageously has a hydraulic adjuster in which a piston connected to the gas exchange valve defines at least one hydraulic working chamber. This hydraulic working chamber can be alternately filled with a highly pressurized pressure fluid and discharged, wherein the filling and discharging of the working chamber takes place by means of control valves in a supply line or discharge line, as a function of operating parameters of the engine. The adjusting force acting on the piston of the hydraulic adjuster from the side of the hydraulic working chamber is counteracted by a constant opposing force directed in the closing direction of the gas exchange valve member. This constantly present closing force can be produced hydraulically or mechanically. The mechanical production of this force takes place by means of springs, while the hydraulic opposing force is produced through the provision of a second hydraulic working chamber which engages the adjusting piston of the gas exchange valve member in opposition to the first hydraulic working chamber. In the exemplary embodiment described, this second hydraulic working chamber that acts in the closing direction advantageously communicates continuously with the high pressure fluid supply line so that the high pressure of the hydraulic adjusting medium continuously prevails in this chamber. Alternatively, it is also possible to produce the adjusting motion in the piston of the gas exchange valve member by means of alternately filling the two hydraulic working chambers in the adjusting piston with a pressure fluid.

Other advantages and advantageous embodiments of the subject of the invention can be inferred from the specification, the claims, and the drawing.

BRIEF DESCRIPTION OF THE DRAWING

An exemplary embodiment of a device for executing the process according to the invention for controlling a gas exchange valve for internal combustion engines is shown in the drawing and will be explained in detail in the description that follows.

The sole FIGURE shows a schematic diagram of a system and device for actuating a gas exchange valve for internal combustion engines, in which the hydraulic adjusting piston of the gas exchange valve member defines two hydraulic working chambers that function in opposition to each other, wherein the hydraulic pressure fluid is supplied by a high pressure pump that can be regulated.

DESCRIPTION OF THE EXEMPLARY EMBODIMENT

Figure 1:
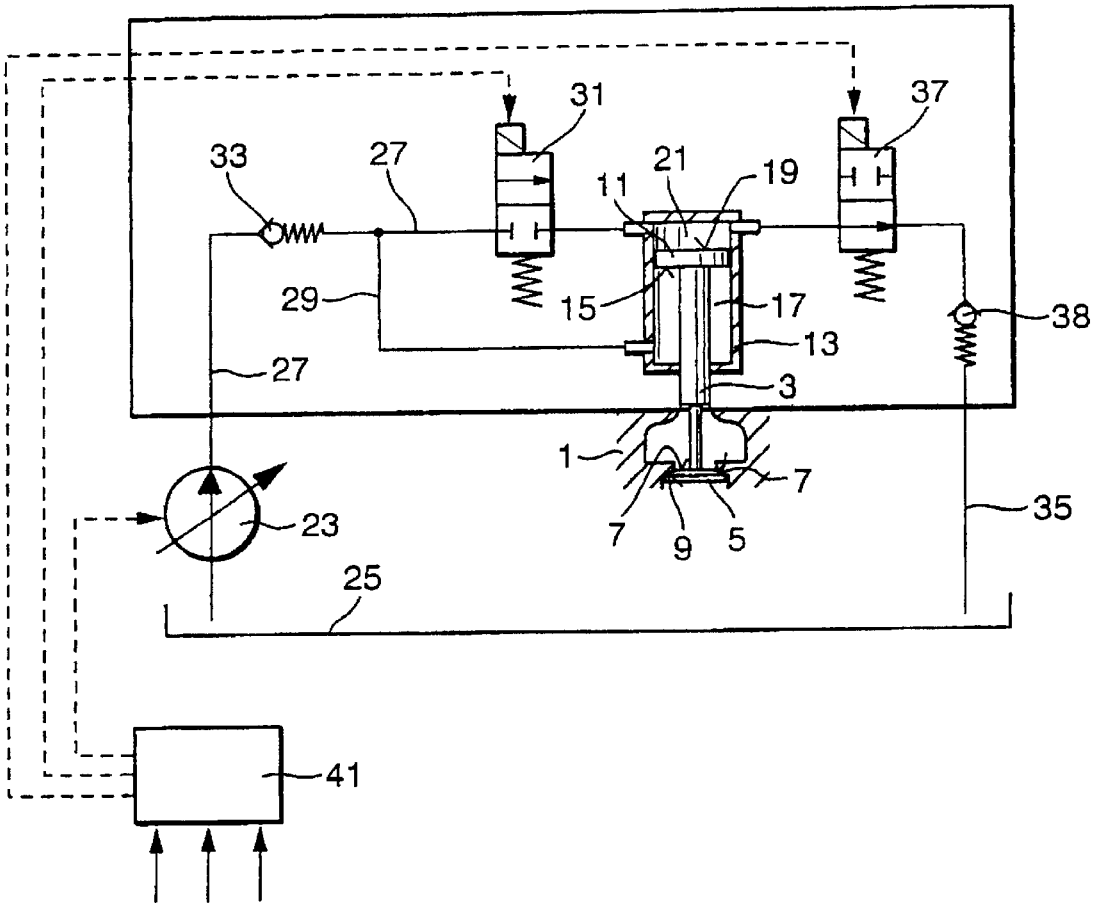

In the device shown in FIG. 1 for controlling a gas exchange valve for internal combustion engines, a piston-shaped valve member 3 of the gas exchange valve is guided so that the valve member can move axially in the housing 1. On its lower end oriented toward the combustion chamber, the gas exchange valve member 3 has a valve disk 5, whose upper end face constitutes a valve sealing face 7. With this valve sealing face 7, the valve member 3 cooperates with a stationary valve seat 9 on the housing 1 and thus controls an inlet or outlet cross section of the housing 1 at the combustion chamber of the engine to be fed, which is not shown in detail. On its upper end remote from the combustion chamber, the valve member 3 has a cross-sectionally enlarged hydraulic adjusting piston 11, which is guided so that its cylindrical circumference wall surface slides in a sealed fashion in a cylinder 13. With its lower annular end face 15 oriented toward the combustion chamber, the piston 11 defines a lower hydraulic working chamber 17, and with its entire upper piston end face 19, the piston 11 defines an upper hydraulic working chamber 21. The hydraulic working pressure present in the lower working chamber 17 thereby acts on the piston 11 in the closing direction of the valve member 3 by way of the lower annular end face 15, while the pressure in the upper working chamber 21 acts on the piston 11 in the opening direction of the valve member 3 by way of the upper piston end face 19.

The hydraulic pressure fluid that actuates the hydraulic valve adjuster is supplied by a high pressure pump 23 that can be regulated, which aspirates the pressure fluid, preferably hydraulic oil or motor oil, from a reservoir 25 and supplies the oil to the cylinder 13 by way of a pressure fluid supply line 27. In this connection, the pressure fluid supply line 27 feeds with its main branch into the upper hydraulic working chamber 21, wherein a branch line 29 leads from the pressure fluid supply line 27 and for its part feeds into the lower hydraulic working chamber 17. In order to control the pressure fluid supply into the upper working chamber, an electric control valve 31 is inserted into the pressure fluid supply line 27 downstream of the split into the branch line 29 and just before the infeed into the upper working chamber 21. In addition, in order to maintain a standing pressure, a first check valve 33 is inserted into the pressure fluid supply line 27 in the flow direction upstream of the split into the branch line 29. In order to relieve pressure in the upper hydraulic working chamber 21 of the valve control device, a discharge line 35 also leads from the upper working chamber 21 and feeds into the reservoir 25; this discharge line 35 also has an electric control valve 37 inserted into the line, which can open or close the discharge line 35. A second check valve 38 is provided in the discharge line 35, downstream of the control valve 37.

For the control according to the invention of the gas exchange actuation device, an electric control unit 41 is also provided, which processes various current operating parameters of the engine to be fed, such as temperature, speed, and load as input values. The regulatable high pressure pump 23 and the electric control valves 31 and 37 are then controlled as a function of these current input values, preferably in a characteristic diagram-controlled manner.

The above-described actuation device for a gas exchange valve for internal combustion engines functions in the following manner. With the beginning of the operation of the internal combustion engine to be fed, the high pressure pump 23 is also driven, preferably with a speed synchronous to that of the engine and thus supplies the pressure fluid from the reservoir 25 under pressure to the pressure supply line 27. In this connection, pressurized pressure fluid travels via the branch line 29 into the lower working chamber 17 that continuously communicates with the pressure supply line 27. In the lower working chamber 17, the high pressure acts on the piston 11 via the annular end face 15 in the closing direction of the valve member 3 so that this valve member 3 is held with its valve sealing face 7 in contact with the stationary valve seat 9. The check valve 33 disposed in the pressure fluid supply line 27 thus assures the maintenance of a particular standing pressure in the branch line 29 and the lower working chamber 17 so that the valve member 3 is held in the closed position even when the engine is switched off. The control valve 31 disposed in the pressure fluid supply line 27 thereby remains in the initial position, i.e. when the gas exchange valve is closed, the infeed of the pressure fluid supply line 27 into the upper working chamber 21 is closed. At the same time, the electric control valve 37 in the discharge line 35 keeps this line open so that a possible high pressure in the upper working chamber 21 can escape into the reservoir 25 and in the rest position, this reservoir 25 is pressure relieved. Here, too, a check valve 38 in the line 35 maintains a particular residual pressure in the upper working chamber 21 and in the line 35, which should prevent an excessively long dead time due to a complete emptying of the upper working chamber 21. In order to open the gas exchange valve, the electric control valves 31 and 37 are triggered in such a way that the control valve 31 now permits the pressure fluid flow into the upper working chamber 21 while the control valve 37 closes the discharge line 35. As a result, the same high pressure of the pressure fluid builds up in the upper working chamber 21 as in the lower working chamber 17, wherein the compressive force acting on the piston 11 in the opening direction of the valve member 3 exceeds the closing force of the lower working chamber 17 due to the larger effective pressure engagement area on the piston 11 and thus permits the valve member 3 to lift off from the valve seat 9 with its valve sealing face in the downward direction. An opening cross section between the valve sealing face 7 and the valve seat 9 at the combustion chamber of the engine to be fed is then opened, via which an inlet or outlet cross section is opened. A corresponding triggering of the control valves 31 and 37 permits all valve member opening positions to be variably adjusted and maintained. The opening of the gas exchange valve is ended by virtue of the fact that the control valves 31 and 37 are triggered again by the electric control unit 41 in such a way that the infeed of the pressure fluid supply line into the upper working chamber 21 is closed and the discharge line 35 leading from it is opened again. As a result, the high pressure in the upper working chamber 21 escapes into the reservoir 25 and the closing force in the lower working chamber 17 acting on the piston 11 of the valve member 3 via the annular end face 15 once more slides the valve member 3 into sealed contact with its valve sealing face 7 against the valve seat 9.

In order to then prevent unnecessarily high pressures of the pressure fluid of the valve control device during particular operating conditions of the engine, the high pressure pump 23 is regulated in such a way that the supply pressure of the pressure fluid is adjusted as a function of current operating parameters of the engine to be fed during its operation. To that end, the high pressure pump can be operated at a motor-synchronous speed, e.g. throttled on the suction side. The control of the various pressure levels can be smoothly changed and is preferably also carried out in a characteristic diagram-controlled manner by means of the electric control unit 41. The smooth adjustment of various supply pressure levels represents another variant of the adjustment of the supply pressure of the valve control device during the operation of the engine. To that end, a number of pressure stages are provided, wherein preferably, even two supply pressure level stages are sufficient. A first lower pressure level stage covers the operating range of the engine in which the engine is operated at low or mid-range speed, load, and temperature. The second pressure level is only adjusted in the high pressure pump 23 when the engine is operated under extreme operating conditions. These extreme operating conditions, for example, are a very low ambient temperature, high speeds, and high loads. In this instance, high restoring forces act on the valve member 3 of the gas exchange valve, which also require high adjusting forces of the hydraulic pressure fluid. In order to prevent an excessively frequent switching back and forth between the individual pressure levels in their boundary regions, a hysteresis function is interposed between the pressure levels in these boundary regions. For example, with a changeover boundary between the pressure levels at a speed of 5000 rpm, this hysteresis function results in the fact that the switching up into the high pressure level only occurs at a speed of approx. 5500 rpm. In contrast to this, the switching down from the high pressure level into the lower pressure level only occurs at a speed of approx. 4500 rpm so that no changeovers occur in an approx. 1000 rpm speed range and consequently, a constant jumping back and forth between the two pressure level stages can be reliably prevented.

With the process according to the invention for controlling a gas exchange valve for internal combustion engines, in particular through the operating point-dependent adaptation of the supply pressure of the pressure fluid of the hydraulic valve adjuster, it is consequently possible to achieve a considerable energy savings in the most frequently used operating range of the engine to be fed. This energy savings is achieved by means of a corresponding reduction in the pressure fluid supply pressure level so that the power consumption of the high pressure pump can be correspondingly reduced, which considerably improves the total energy balance of the engine.

The foregoing relates to a preferred exemplary embodiments of the invention, it being understood that other variants and embodiments thereof are possible within the spirit and scope of the invention, the latter being defined by the appended claims.

What is claimed is:

1. A system for controlling a gas exchange valve for internal combustion engines, which system comprises:

a housing, a movable valve member (3) in said housing, which, on an end close to a combustion chamber of the engine, has a valve sealing face (7), said valve sealing face cooperates with a valve seat (9) in order to control an inlet or outlet cross section to or from the combustion chamber of the engine and on an end remote from the combustion chamber said movable valve has a working piston (11) which defines at least one hydraulic working chamber (21) which is alternatingly filled with a pressure fluid and discharged of said fluid to move the valve member (3) in an opening and closing direction, whereby the supply pressure of the pressure fluid supplied for the actuation of the gas exchange valve member (3) is adjusted as a function of current operating parameters of the engine during the operation of the engine, wherein the supply pressure of the valve control device is adjusted step wise during the operation of the engine as a function of engine operating parameters.

2. The system according to claim 1, in which the supply pressure of the valve control device is smoothly changed during an operation of the engine as a function of engine operating parameters.

3. The system according to claim 2, in which an adjustment of the supply pressure takes place in a characteristic diagram-controlled manner.

4. The system according to claim 1, in which two pressure level stages are provided in said housing.

5. The system according to claim 4, in which a hysteresis function is provided between a changeover between the individual pressure level stages, in a boundary region between the pressure stages.

6. The system according to claim 2, in which a supply pressure of the valve control device is adjusted as a function of the temperature, load, and speed of the engine.

7. The system according to claim 1, in which a supply pressure of the valve control device is adjusted as a function of the temperature, load, and speed of the engine.

8. The system according to claim 1, in which the supply pressure of the valve control device is produced by a regulatable pump (23).

9. The system according to claim 8, in which the pump (23) is regulated on a pressure side.

10. The system according to claim 9, in which the pump is regulated on a suction side.

11. The system according to claim 1, in which a constantly present opposing force engages a lower piston end face (15) disposed opposite from the upper piston end face (19) that defines a working chamber (21) that is alternatingly filled with pressure fluid and discharged, and this opposing force counteracts an opening compressive force against the upper piston end face (19) of the gas exchange valve member (3) and holds the gas exchange valve member (3) in a closed position when the hydraulic pressure chamber (21) is not pressurized.

12. The system according to claim 11, in which the constantly present opposing force in the closing direction is embodied as a hydraulic compressive force that is produced in a second hydraulic working chamber (17).

13. The system according to claim 12, in which the supply high pressure of the pressure fluid constantly prevails in the second hydraulic working chamber (17) that acts on the gas exchange valve member (3) in the closing direction.

14. A system for controlling a gas exchange valve for internal combustion engines, which system comprises:

a housing, a movable valve member (3) in said housing which, on an end close to a combustion chamber of the engine, has a valve sealing face (7), said valve sealing face cooperates with a valve seat (9) in order to control an inlet or an outlet to or from the combustion chamber of the engine and on an end remote from the combustion chamber said movable valve has a working piston (11) which defines at least one hydraulic working chamber (21) which is alternatingly filled with a pressure fluid and discharged of said fluid to move the valve member (3) in an opening and closing direction, said fluid being supplied from a single pressure reservoir which is pressurized in a step wise fashion according to current operating parameters of the engine, so that the working piston is acted on by fluid at step wise varied pressures to open or close the valve with varied force according to the current operating parameters of the engine.

* * * * *